US007686264B2

(12) United States Patent
Dicke

(10) Patent No.: US 7,686,264 B2
(45) Date of Patent: Mar. 30, 2010

(54) QUICK RELEASE MECHANISM FOR USE WITH A SIGN STAND

(75) Inventor: Grant D. Dicke, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 229 days.

(21) Appl. No.: 12/069,225

(22) Filed: Feb. 8, 2008

(65) Prior Publication Data

US 2009/0199446 A1 Aug. 13, 2009

(51) Int. Cl.
*A47B 91/00* (2006.01)

(52) U.S. Cl. ..... 248/188.7; 248/170; 248/519

(58) Field of Classification Search ..... 248/519, 248/163.1, 166, 168, 169, 170, 171, 436, 248/188.6, 188.7, 83, 84, 164, 173, 440, 248/188.8, 188.91

See application file for complete search history.

(56) References Cited

U.S. PATENT DOCUMENTS 4,548,379 A 10/1985 Seely et al.
4,593,879 A 6/1986 Seely et al.
4,694,601 A 9/1987 Dicke et al.
4,954,008 A * 9/1990 Dicke et al. ..... 403/24
5,310,145 A * 5/1994 Chen ..... 248/170
5,340,068 A 8/1994 Sarkisian et al.
5,611,509 A 3/1997 Kulp et al.

(Continued)

OTHER PUBLICATIONS

Exhibit A is a photograph of a fragmentary portion of a sign stand commercially available from the Sign-Up Corporation, P.O. Box 14624, Portland, Oregon 97293. The photograph is not prior art but shows a sign stand that was commercially available prior to the invention as shown and described in the accompanying patent application. The same sign stand is the subject of Exhibits A-C.

(Continued)

*Primary Examiner*—Anita M King
(74) *Attorney, Agent, or Firm*—Olson & Cepuritis, Ltd.

(57) ABSTRACT

A sign stand assembly includes a support base with a plate portion defining a locking recess, an upright mast joined to the support base, and at least one leg having a wall defining a hollow interior of the leg. The leg is pivotally attached to the plate portion, and a locking pin carried on the leg, is provided for movement toward and away from the locking recess defined by the plate portion of the support base. An actuator is movable between lock and unlock positions and has a first end portion engaging the locking pin, and an opposed second end portion with a hollow bail member defining a hollow interior for receiving the leg. A fulcrum portion is located adjacent the first end portion and engages the leg, whereby, upon pressing the bail member, the locking pin is retracted to the unlock position.

21 Claims, 6 Drawing Sheets

U.S. PATENT DOCUMENTS

| | | | | |
|---|---|---|---|---|
| 6,041,681 | A * | 3/2000 | Griffin, Sr. | 81/462 |
| 6,626,410 | B2 * | 9/2003 | Marcotte et al. | 248/548 |
| 6,685,156 | B2 | 2/2004 | Dicke et al. | |
| 6,793,191 | B1 | 9/2004 | Williams et al. | |
| 2002/0096617 | A1 * | 7/2002 | Marcotte et al. | 248/548 |

OTHER PUBLICATIONS

Exhibit B is a line drawing depicting the sign stand of Exhibit A. The drawing is not prior art but shows a sign stand commercially available prior to the invention described and claimed in the accompanying patent application. The same sign stand is the subject of Exhibits A-C.

Exhibit C is a photograph of a fragmentary portion of a sign stand commercially available from the Sign-Up Corporation, P.O. Box 14624, Portland, Oregon 97293. The photograph is not prior art but shows a sign stand that was commercially available prior to the invention as shown and described in the accompanying patent application. The same sign stand is the subject of Exhibits A-C.

* cited by examiner

QUICK RELEASE MECHANISM FOR USE WITH A SIGN STAND

FIELD OF THE INVENTION

The present invention pertains to quick release mechanisms for use with sign stands and similar devices, and in particular with collapsible light weight sign stands.

DESCRIPTION OF THE RELATED ART

Portable sign stands are employed for a variety of uses, including warning motorists and pedestrians as to ongoing work site activity. Work site operations are sometimes operated only briefly, and it is desirable to provide warning signs which can be quickly and easily deployed and removed several times throughout a workday. One popular arrangement for these types of sign stands uses hollow rigid tubing such as relatively light weight metallic tubing for ground engaging legs of an upright sign-supporting mast. It has been found convenient to arrange the legs to lie parallel to the mast for compact storage. In one popular arrangement, the legs are pivotally attached to the upright mast for movement between an open or deployed position and a closed position extending along the longitudinal axis of the mast. Examples of these types of sign stand arrangements may be found in commonly assigned U.S. Pat. Nos. 6,793,191; 6,685,156; 5,340,068; 4,593,879; 4,548,379; and 4,694,601. Improvements such as those providing reduced costs of manufacture and simplicity of operation are still being sought, despite favorable acceptance of existing sign stand designs.

SUMMARY OF THE INVENTION

The present invention, in one instance, provides a novel and improved sign stand assembly that minimizes disadvantages associated with the prior art arrangements and provides advantages in construction, mode of operation and use. One embodiment of the sign stand assembly comprises a sign panel, a support base, an upright mast joining the sign panel and the support base. The support base includes a plurality of plate portions which define separate locking recesses, and a plurality of legs that are pivotally connected to the plate portions. A locking pin carried on each leg is movable toward and away from a locking recess defined in the plate to which the leg is attached. An actuator is pivotally mounted to the leg and has a first end engaging the locking pin and a second end engageable by an operator, for foot or hand actuation, for example.

In another instance, a sign stand assembly includes a support base with a plate portion defining a locking recess, an upright mast joined to the support base, and at least one leg having a wall defining a hollow interior of the leg. The leg is pivotally attached to the plate portion, and a locking pin carried on the leg, is provided for movement toward and away from the locking recess defined by the plate portion. An actuator is movable between lock and unlock positions and has a first end portion engaging the locking pin, and an opposed second end portion with a hollow bail member defining a hollow interior for receiving the leg. A fulcrum portion is located adjacent the first end portion and engages the leg, whereby, upon pressing the bail member, or a portion of the actuator between the fulcrum and the bail member, the locking pin is retracted to the unlock position.

DETAILED DESCRIPTION OF THE PREFERRED EMBODIMENT

Figure 1:
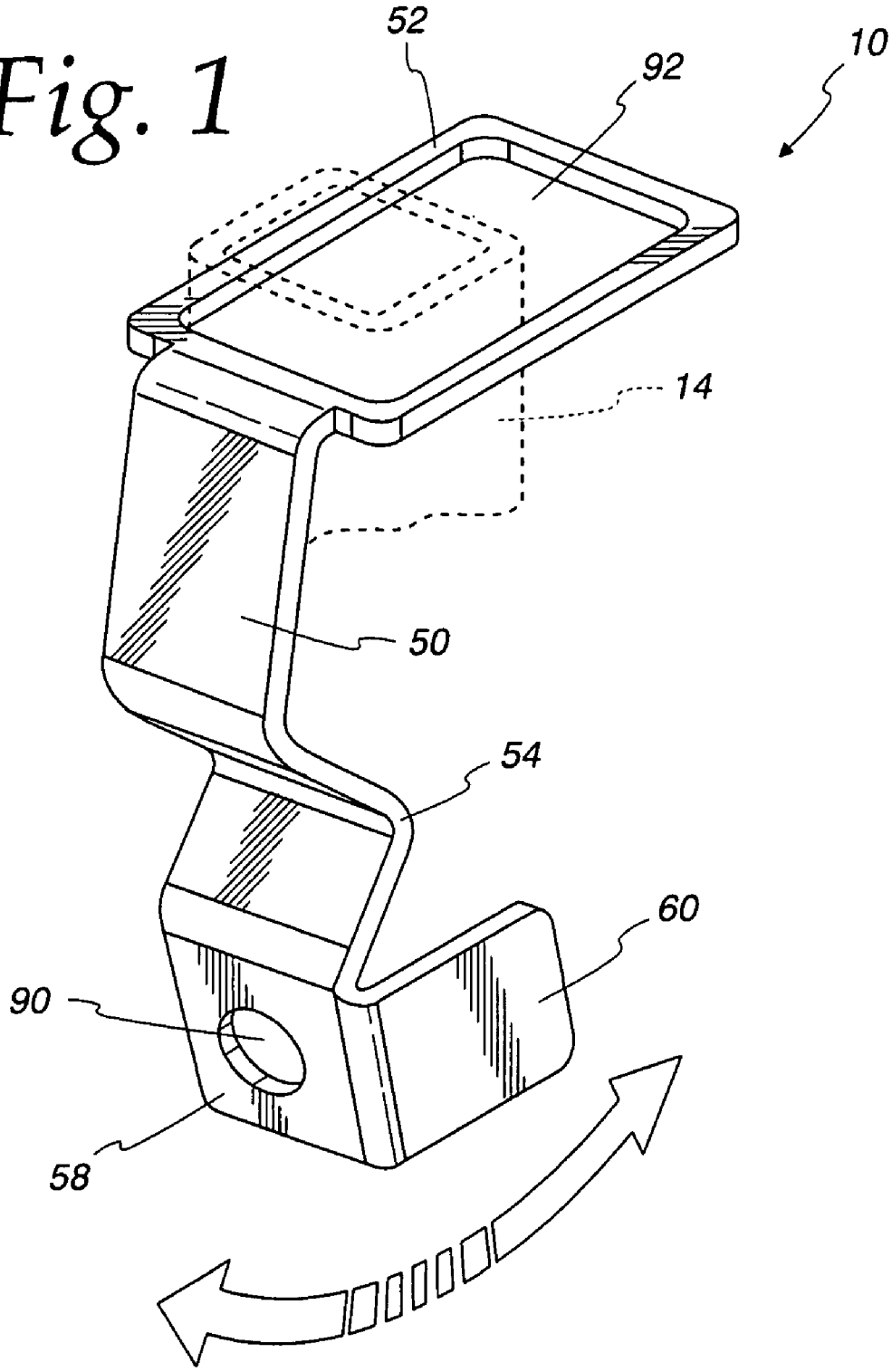
FIG. 1 is a perspective view of an actuator according to principles of the present invention.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments.

For ease of description, sign stand assemblies utilizing actuators embodying the present invention are described herein below in their usual assembled position as shown in the accompanying drawings, and terms such as upper, lower, horizontal, longitudinal, etc. may be used herein with reference to this usual position. However, the equipment may be manufacturing, transported, sold or used in orientations other than those described and shown herein.

Figure 2:
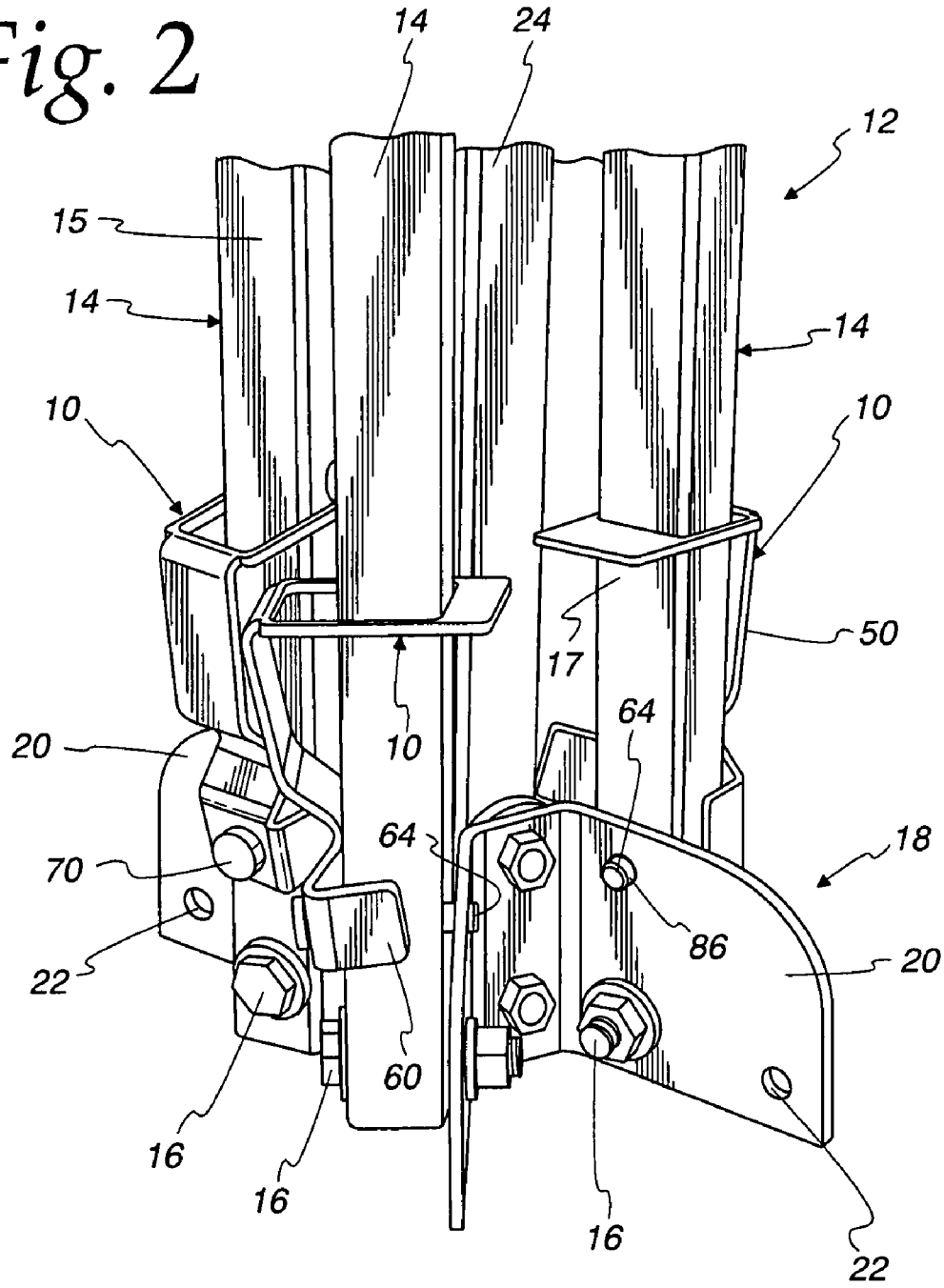
FIG. 2 is a fragmentary perspective view of a sign stand assembly with the actuator of FIG. 1.
Figure 9:
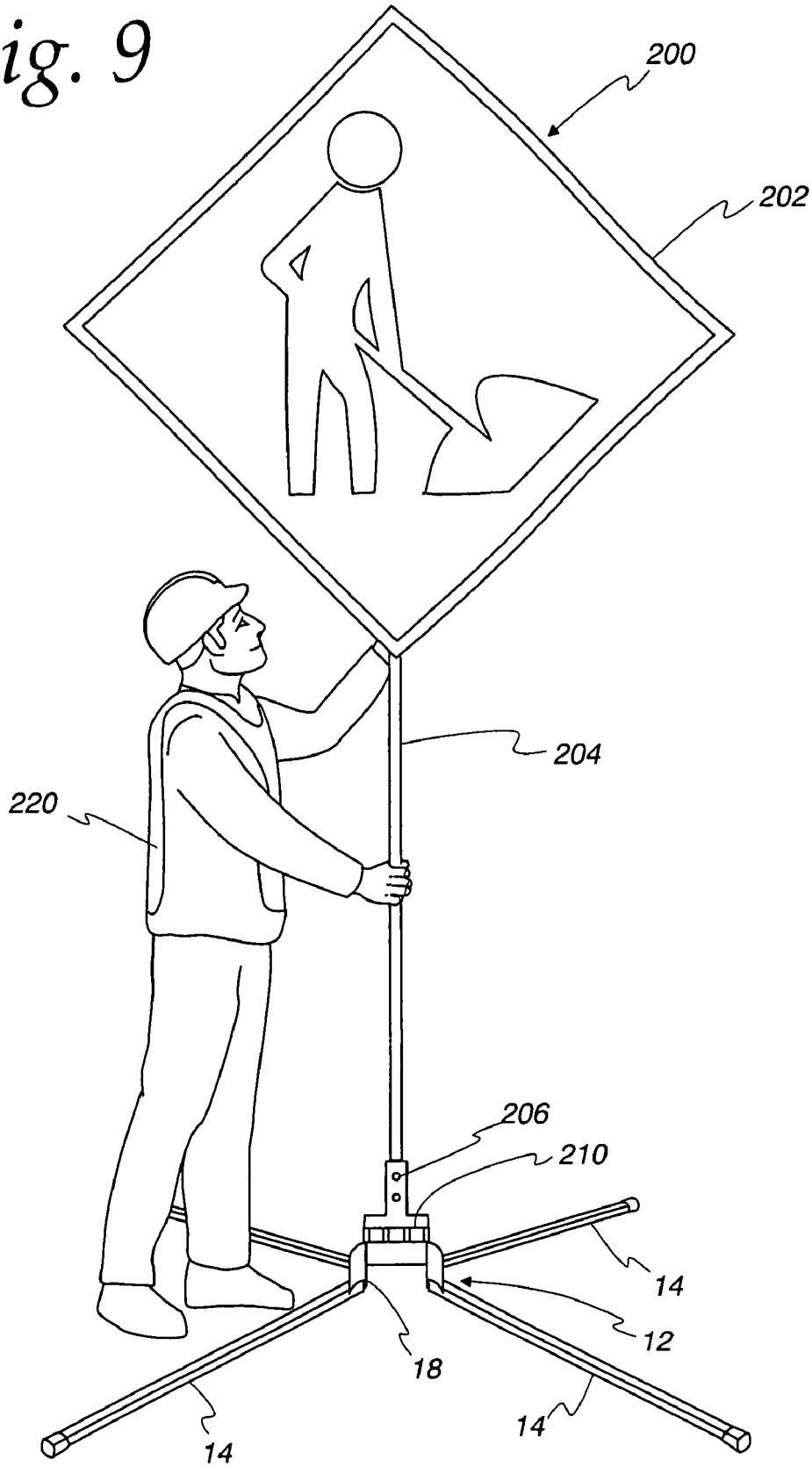
FIG. 9 is a schematic perspective view of a sign stand assembly according to principles of the present invention.

Referring to the figures, apparatus embodying the present invention provides an actuator 10 shown for example in FIG. 1. A slightly different version of actuator 10 is shown installed in a sign stand base assembly generally indicated at 12 in FIG. 2. Included in the sign stand base assembly 12 is a plurality of hollow legs 14 having upper free ends (not shown in FIG. 2) and lower free ends secured, by threaded fasteners 16 to a base subassembly 18. Base 18 includes mounting plates 20 having apertures for receiving threaded fasteners 16 and a plurality of locking apertures 22 and upright mast 24 is secured to plates 20 by threaded fasteners, as can be seen in FIG. 2. Actuators 10 are shown secured to respective legs 14. Referring additionally to FIG. 9, base subassembly 18 is connected through a torsion spring 210 and bracket 206 to an upright mast 204 that supports a display panel 202 in a known manner. With the present invention, an operator 220 can quickly and easily deploy the overall sign stand assembly 200 at a desired location, despite local traffic and other hindrances.

Figure 5:
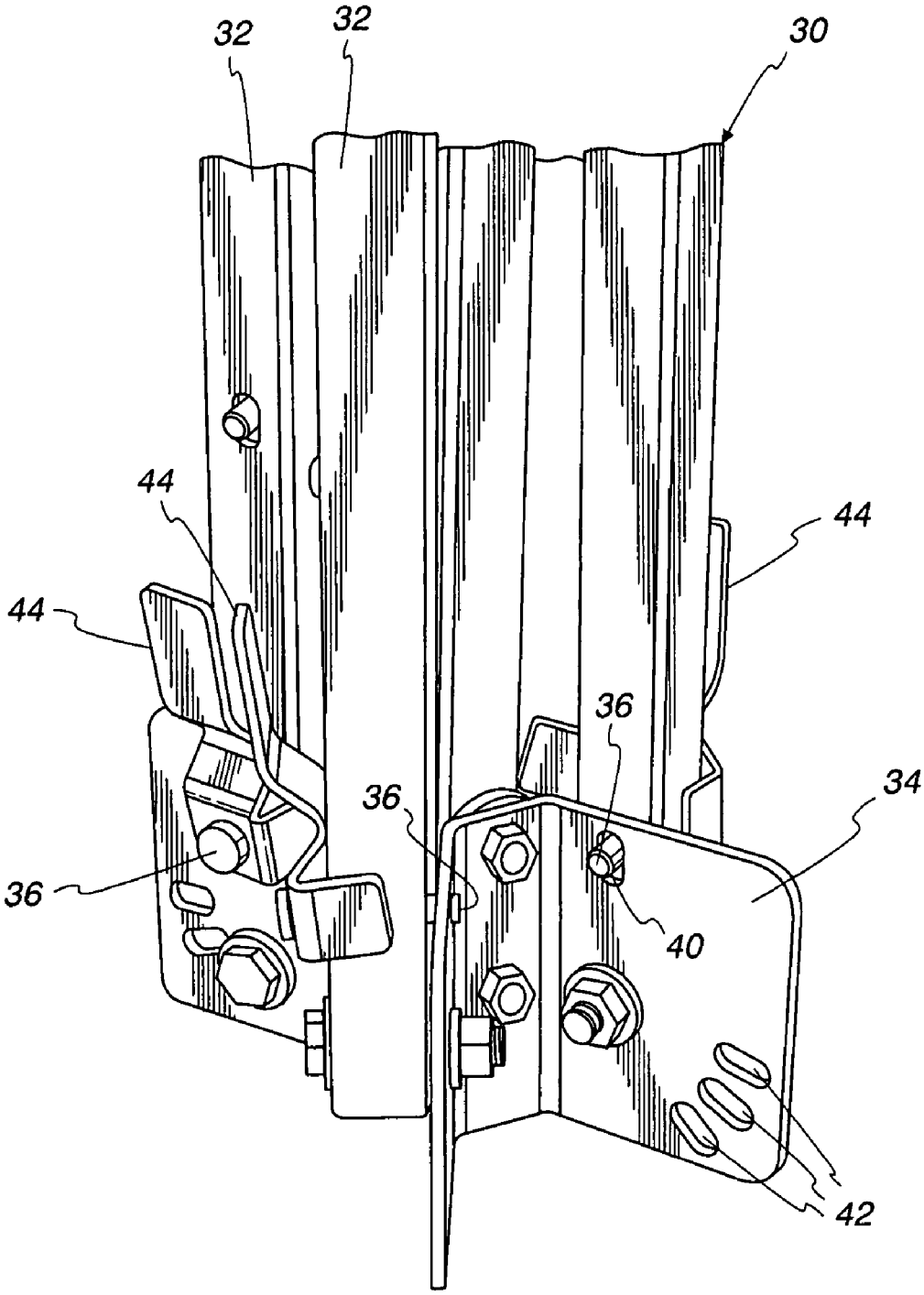
Fig. 5 (Prior Art)
FIG. 5 is a fragmentary perspective view of a prior art sign stand assembly.

Referring now to FIG. 5, a prior art arrangement is generally indicated at 30 and includes hollow legs 32 secured at their lower ends to a base 34. Legs 32 include locking pins 36 held captive within the legs and biased by springs, not shown. Locking pins 36 selectably engage either a locking hole 40 for storing the legs in an upright direction, as shown, or a series of locking holes 42 to maintain legs in an open or deployed position. Locking pins 36 are operated by depressing handles 44 toward their respective legs, thereby causing the locking pins to be withdrawn toward the legs, clearing the holes formed in mounting base 34. The stand illustrated in FIG. 5 is commercially available from the Sign-Up Corporation, P.O. Box 14624, Portland, Oreg. 97293.

Figure 3:
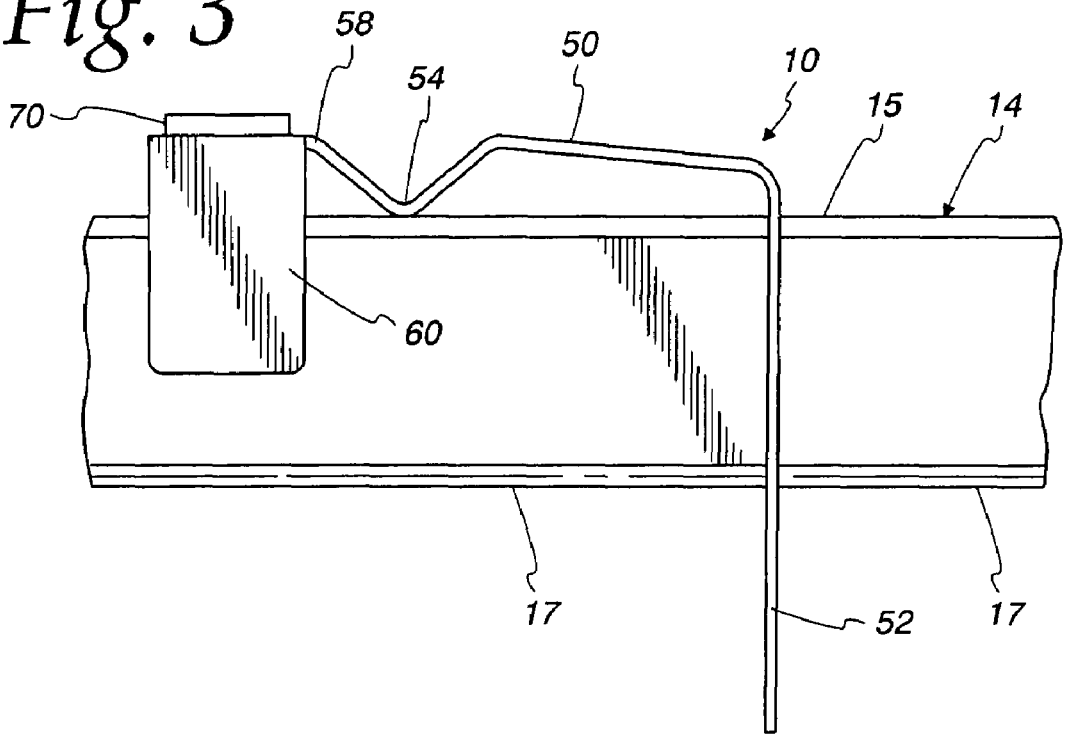
FIG. 3 is a fragmentary side elevational view of one leg thereof.
Figure 4:
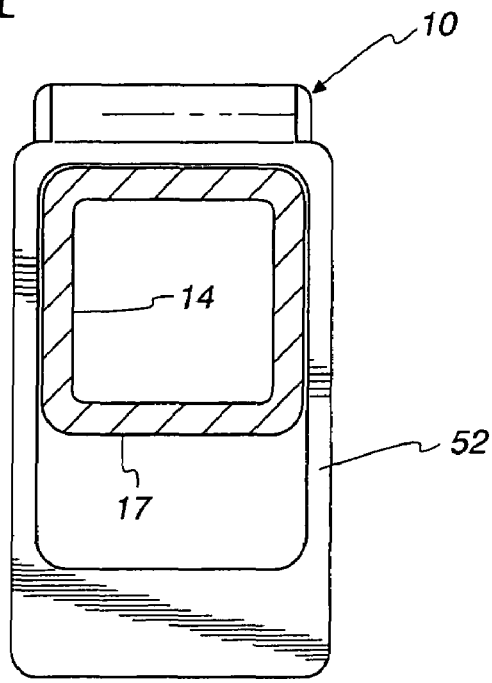
FIG. 4 is a cross-sectional view taken along the line 4-4 of FIG. 3.

Referring now to FIGS. 3 and 4, actuator 10 includes a medial portion 50 disposed between a looped bail portion 52 and a fulcrum portion 54. A pin-engaging portion 58 is located at the free end of actuator 10, to one side of fulcrum portion 54. As can be seen in FIG. 3, medial portion 50, fulcrum portion 54 and pin-engaging portion 58 face a first surface 15 of leg 14 (see also, FIG. 1). A pair of downward ears 60 extends from the pin-engaging portion 58 toward an opposite surface 17 of leg 14, so as to straddle opposing sides of leg 14. As can be seen for example in FIG. 4, leg 14 is preferably hollow and, as will be seen, includes a number of working components arranged in association with actuator 10. FIG. 4 shows an actuator with a bail portion 52 that has a thickened or widened bottom portion, as compared to the bail portion 52 shown in FIG. 1. Referring briefly to FIG. 2 one added advantage of having a widened bail portion is that an operator can release the legs by pressing downward on that part of the bail portion adjacent leg surface 17, in addition to pressing sideways on the medial portion of the actuator, located between the fulcrum and the bail portion. In either arrangement, the bail portion provides improved operation not possible with prior art arrangements, as will be seen.

Figure 6:
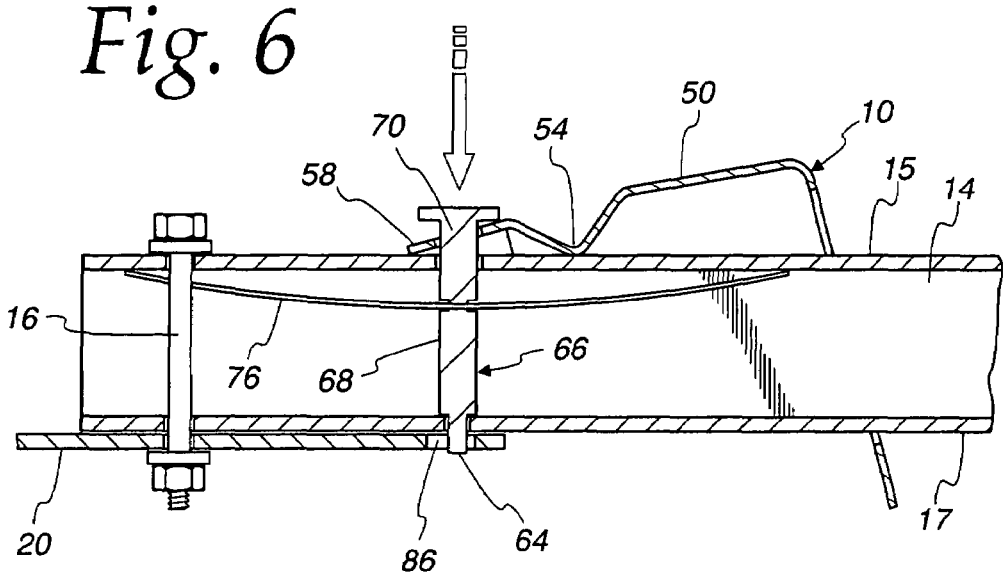
FIG. 6 is a fragmentary cross-sectional view taken along the line 6-6 of FIG. 4.
Figure 7:
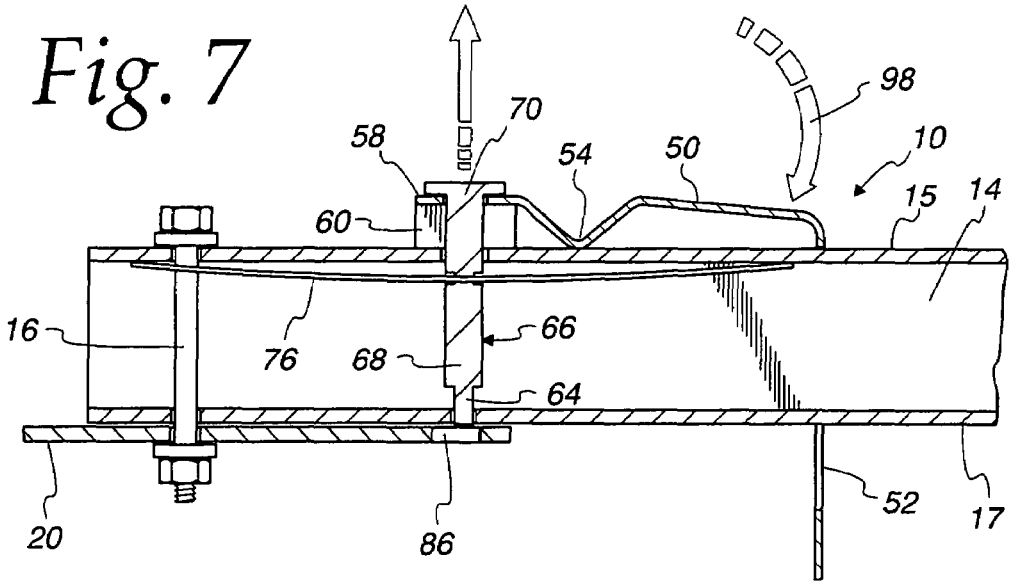
FIG. 7 is a cross-sectional view similar to that of FIG. 6 but showing the actuator in a different stage of operation.
Figure 8:
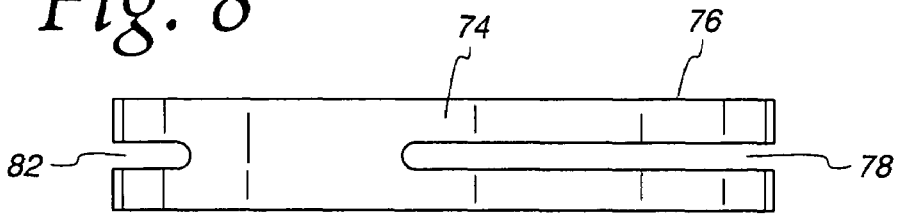
FIG. 8 is a top plan view of a leaf spring shown in FIGS. 6 and 7.

Referring now to FIGS. 6-8, actuator 10 forms part of a locking mechanism for moving locking tip or pin 64 between an extended or locking position illustrated in FIG. 6 and a retracted or unlocked position illustrated in FIG. 7. Locking pin 64 is preferably carried at the free end of a shoulder pin 66, and has a body 68 dimensioned larger than locking pin 64 and having an enlarged head 70. Pin 66 further includes an annular recess for receiving a bifurcated portion 74 of a leaf spring 76 shown in FIG. 8. As can be seen in FIG. 8, leaf spring 76 includes an elongated slot 78 which receives the annular depression of pin 66 thus, in the arrangements shown in FIGS. 6 and 7, leaf spring 76 is held captive with pin 66. In FIG. 6, spring 76 is in its relaxed position, urging locking pin 64 to the extended, locking position so as to protrude beyond the opposite surface 17 of leg 14. FIG. 7 shows leaf spring 76 in a depressed position storing spring force which, when allowed to release, urges pin 66 in a downward direction to assume the position illustrated in FIG. 6. In the unlocked or retracted configuration shown in FIG. 7, locking pin 64 is retracted beneath opposite surface 17 of leg 14.

Referring again to FIG. 8, leaf spring 76 includes a slotted free end 82 which, with reference to FIGS. 6 and 7, is held captive to the through-bolt fastener 16 which pivotably mounts leg 14 to plate 20. In the arrangement illustrated, locking pin 64 is shown in alignment with a locking hole 86 which secures the leg in an upright storage position illustrated, for example, in FIG. 2. With the locking pin 64 in the extended position illustrated in FIG. 6, leg 14 is locked in an upright position parallel to upright mast 24, as can be seen in FIG. 2 (see also mast 204 in FIG. 9). With reference to FIGS. 2 and 7, with the locking pin retracted as illustrated in FIG. 7, leg 14 is free to pivot about bolt 16, so as to bring locking pin 64 into alignment with the locking hole 22, thereby securing the leg in an open or extended position. Referring additionally to FIG. 1, the pin engaging portion 58 of actuator 10 includes an aperture 90 for receiving pin 66. Bail portion 52 includes a central opening 92 for receiving leg 14. As indicated in FIG. 1, bail portion 52 completely encircles leg 14, extending in a closed loop path, surrounding all four sides of the hollow leg. If desired, the bail portion could be opened (in a C-shape or U-shape configuration, for example), so as to extend along an open loop path.

Referring again to FIGS. 6 and 7, with the springs 76 in a relaxed position indicated in FIG. 6, locking pin 64 protrudes beyond leg 14, while the shoulder portion of pin 66 engages the leg wall so as to prevent further extension of the locking pin, beyond its designed point. The enlarged head 70, with the remainder of pin 66, is biased in a downward direction under the force of spring 76, thereby causing rotation of actuator 10 in a counterclockwise direction about fulcrum portion 54, bringing pin engaging portion 58 toward leg 14. In the preferred embodiment, with pin 66 fully extended, further extension of the locking pin is prevented not only by engagement of the shoulder portion of pin 66 with leg 14, but also by the engagement of bail portion 52 with the opposite side 17 of leg 14. It is generally preferred to maintain such engagement, even if the bail portion is opened somewhat from the most preferred configurations shown if the figures.

When deployment of the sign stand base is desired, several options are presented for unlocking legs 14. In a first option, an operator can depress medial portion 50 of actuator 10 to move the actuator in the direction of arrow 98 in FIG. 7, causing the actuator to pivot about fulcrum portion 54 so as to move pin 66 to the retracted position illustrated in FIG. 7. This option is more difficult to carry out for an operator that stands next to the sign assembly, as depicted in FIG. 9. With reference to FIG. 2, this would require the operator to push the medial portion 50 of the actuator in a sideways direction. As a second, and more preferred option, an operator can depress the free end of bail portion 52 (located adjacent the opposite side 17 of leg 14) to achieve the same desired withdrawal of locking pin 64 as that illustrated in FIG. 7. With reference to FIG. 2, a downward pushing is a more natural and better balanced motion for the operator, a feature that is especially attractive when the sign stand must be erected in hectic conditions caused by wind gusts or passing vehicles. To achieve these advantages the free end of the bail portion (located on the opposite side 17 of leg 14), can have either a low profile configuration as illustrated in FIG. 1, or a higher profile configuration as illustrated in FIG. 2, for example.

Actuator 10 provides a number of additional advantages which benefit both the construction and operation of a sign stand base. For example, as mentioned above, bail portion 52 preferably completely encircles leg 14. This constrains deflection of the actuator in a number of different directions preventing unintentional misalignment and premature component failure. As will be appreciated by those still in the art, sign stand bases are often subjected to rough handling, occasioned for example by piling the sign stand bases in a work truck at the conclusion of a work day. At times, erection of the sign stand base can be rendered difficult by strong gusts of winds due not only to weather conditions but also nearby traffic. Accordingly, an operator's attention may be temporarily distracted away from the careful handling of the sign stand base. The fully or partly encircling bail portion prevents dislocation of actuator 10, thus ensuring its reliable operation over periods of continued use.

With an arrangement such as that illustrated in FIG. 5, an operating handle can be subjected to unintentional over-travel away from the leg to which it is attached. This is prevented by the bail portion of actuator 10. Further, most of the prior art handle portion of FIG. 5 is unsupported against unintentional lateral movement in directions generally perpendicular to the axis of the leg to which it is attached. Thus, although the pairs of ears provided in the arrangement illustrated in FIG. 5 support the lower end of the operating handle, they leave the upper ends of the handle exposed and unsupported. With the present invention, bail portion 52 cooperates with optional, downwardly extending tabs 60, when provided, to add secure support at both ends of actuator 10. If necessary, the bail portion can be relied upon to provide sole lateral support for the actuator, in the absence of tabs 60.

Further, the actuator 10 introduces a reinforcing bend between the bail 52 and intermediate portion 50, a further advantage not present in the prior art. In addition, actuator 10 provides alternative operation for releasing the locking pin from it's locked condition with the legs at both storage and operational positions. Because of the increased support, the actuator 10 according to the present invention can be made of lighter gauge, lighter weight, or more economical materials. By comparing actuator 10 in FIG. 1, for example, to the operating handle shown in FIG. 5, it will be appreciated that actuator 10 has a substantially more complex shape. However, those skilled in the art will readily appreciate that actuator 10 can be economically formed using conventional progressive tool die operations, which can be conveniently provided using a single punch press if desired.

Certain variations are contemplated by the present invention. For example, the bail member can be formed with an opening, while still allowing the bail member to substantially encircle the leg to which the actuator is joined. As a further alternative, the bail member could be replaced with an elongated relatively narrow portion extended through slots (preferably elongated slots) formed in surfaces 15, 17 of leg 14. This would, however, require an added machining step to be performed on each of the legs of the sign stand base assembly.

As shown, the bail member is four-sided, but could be replaced by a member which is either three-sided, so as to form a C- or U-shape or a two-sided member forming an L-shape. Rather than encircle or substantially encircle leg 14, the bail could merely wrap around one side of the leg so as to have a free end that overlies the opposite side 17 of the leg. Although a leaf spring is generally preferred, one or more coil springs could be used as a replacement. If desired, the downwardly extending ears adjacent the pin portion could be replaced by a bail member, if desired.

The foregoing descriptions and the accompanying drawings are illustrative of the present invention. Still other variations and arrangements of parts are possible without departing from the spirit and scope of this invention.

What is claimed is:

1. A sign stand assembly comprising:

a support base including a plate portion defining a locking recess;

an upright mast joined to the support base;

at least one leg having a wall defining a hollow interior of the leg;

a pivotal connection pivotally connecting the leg to the plate portion;

a locking pin carried on the leg, for movement toward and away from the locking recess defined by the plate portion of the support base; and an actuator movable between lock and unlock positions having a first end portion engaging said locking pin, an opposed second end portion with a hollow bail member defining a hollow interior for receiving the leg, a fulcrum portion adjacent the first end portion and engaging the leg, and a medial portion between the fulcrum portion and the bail member;

whereby, upon pressing the bail member, the locking pin is retracted to the unlock position.

2. The sign stand assembly of claim 1 wherein said locking pin extends through the leg.

3. The sign stand assembly according to claim 1 wherein said locking pin is biased for movement toward the lock position.

4. The sign stand assembly of claim 1 wherein the locking pin comprises a shoulder pin that extends through the actuator first end portion.

5. The sign stand assembly of claim 4 wherein the shoulder pin is biased to a locking position.

6. The sign stand assembly of claim 5 wherein the shoulder pin is biased by a leaf spring.

7. The sign stand assembly of claim 6 wherein the leaf spring is bifurcated to engage a portion of the shoulder pin.

8. The sign stand assembly according to claim 1 wherein the pivotal connection of said at least one leg comprises a bolt fastener extending through said plate portion and said at least one leg.

9. The sign stand assembly of claim 1 wherein the actuator further includes a pair of ears straddling opposite sides of the leg so as to constrain movement of the actuator as it travels between lock and unlock positions.

10. The sign stand assembly according to claim 1 wherein said locking pin has a generally cylindrical body with a second end portion of predetermined size remote from said plate portion and an opposed first end portion of reduced size adjacent said plate portion, with a stepped shoulder between said first and said second end portions.

11. The sign stand assembly according to claim 1 wherein said first end portion of said actuator includes an aperture receiving the first end portion of said locking pin and the second end of the locking pin includes an enlarged head dimensioned for interfering contact with the actuator to receive an actuating force to move said locking pin away from said locking recess.

12. The sign stand assembly according to claim 10 wherein the pivotal connection of said leg comprises a bolt fastener extending through said plate portion and said leg.

13. An actuator for a leg of a sign stand base assembly, comprising:

a monolithic body extendible along the leg in a first direction, and having first and second opposed free ends;

a fulcrum portion between the first and the second ends extendible toward the leg for rocking engagement therewith and for supporting the first and the second ends away from the leg while selectably allowing one of the first and the second ends to move toward the hollow leg;

the first end including a pin engaging portion for engaging a locking pin that passes through the leg, extending at an angle to the first direction; and a hollow bail member at the second end, extending at an angle to the first direction, and defining a hollow interior for receiving the leg and for moving back and forth about the leg as the body is rocked about the leg.

14. The actuator according to claim 13 wherein the hollow bail member traverses a substantially closed loop path.

15. The actuator according to claim 13 wherein the hollow bail member traverses a closed loop path so as to encircle the hollow leg.

16. A sign stand assembly comprising:

a support base including a plurality of plate portions each defining a locking recess;

an upright mast joined to the support base;

a plurality of legs, each leg having a wall defining a hollow interior of the leg;

a plurality of pivotal connections pivotally connecting the legs to the plate portions;

a plurality of locking pins, each locking pin carried on one of the legs, for movement toward and away from the locking recess defined by an adjacent plate portion; and a plurality of actuators, each movable between lock and unlock positions having a first end portion engaging one of said locking pins, an opposed second end portion with a hollow bail member defining a hollow interior for receiving one of the legs, a fulcrum portion adjacent the first end portion and engaging the one leg, and a medial portion between the fulcrum portion and the bail member;

whereby, upon pressing one of the bail members, the associated locking pin is retracted to the unlock position.

17. The sign stand assembly of claim 16 wherein each said locking pin extends through the leg with which it is associated.

18. The sign stand assembly according to claim 17 wherein said locking pins are biased for movement toward their respective lock position.

19. The sign stand assembly of claim 18 wherein the locking pins comprise shoulder pins that extend through the first end portion of a respective actuator.

20. The sign stand assembly of claim 19 wherein the shoulder pins are biased by respective leaf springs.

21. The sign stand assembly of claim 20 wherein the leaf springs are bifurcated to engage a portion of a respective shoulder pin.

* * * * *

UNITED STATES PATENT AND TRADEMARK OFFICE

CERTIFICATE OF CORRECTION

PATENT NO. : 7,686,264 B2
APPLICATION NO. : 12/069225
DATED : March 30, 2010
INVENTOR(S) : Grant D. Dicke It is certified that error appears in the above-identified patent and that said Letters Patent is hereby corrected as shown below:

Column 2, line 13, the word "and" should be deleted
Column 2, line 39, the word "manufacturing" should be "manufactured"
Column 2, line 47, there is a "," after the word "secured" and should be deleted
Column 2, line 52, "Actuators 10 are shown" should be "Actuator 10 is shown"
Column 4, line 19, the word "if" should be "in"

Signed and Sealed this
Fifth Day of April, 2011

David J. Kappos

David J. Kappos
*Director of the United States Patent and Trademark Office*